US008717849B1

(12) United States Patent
Zarnetske et al.

(10) Patent No.: US 8,717,849 B1
(45) Date of Patent: May 6, 2014

(54) SLOTTED CYLINDER ACOUSTIC TRANSDUCER

(75) Inventors: Michael R. Zarnetske, Bristol, RI (US); Robert S. Janus, Hope, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 304 days.

(21) Appl. No.: 13/228,680

(22) Filed: Sep. 9, 2011

(51) Int. Cl.
*H04R 17/00* (2006.01)

(52) U.S. Cl.
USPC ..... 367/157

(58) Field of Classification Search
USPC ..... 367/157
See application file for complete search history.

(56) References Cited

U.S. PATENT DOCUMENTS 2,812,452 A * 11/1957 Harris ..... 367/157
3,773,898 A * 11/1973 Aizu et al. ..... 310/332
4,651,044 A * 3/1987 Kompanek ..... 367/157
5,229,978 A * 7/1993 Flanagan et al. ..... 367/157
5,267,223 A * 11/1993 Flanagan et al. ..... 367/159
6,002,649 A * 12/1999 Janus ..... 367/162
6,069,845 A * 5/2000 Ambs ..... 367/159
7,719,926 B2 * 5/2010 Brogan et al. ..... 367/159
2009/0245027 A1 * 10/2009 Brogan et al. ..... 367/155

* cited by examiner

*Primary Examiner* — Daniel Pihulic
(74) *Attorney, Agent, or Firm* — James M. Kasischke; Michael P. Stanley

(57) ABSTRACT

A slotted cylinder acoustic transducer assembly is provided that has a cylindrical housing shell and an electromechanical driver disposed within the shell. The driver is formed with a plurality of single crystal piezoelectric elements joined to the inner surface of the housing shell and arranged to form an electromechanical stack. Each piezoelectric element has a pair of sidewalls, wherein each sidewall provides an electrode having a predetermined polarity. Each single piezoelectric element has a tapering width between the sidewalls. The transducer assembly includes a plurality of electrically conductive members. Each conductive member is disposed between each pair of adjacent piezoelectric elements such that each electrically conductive member electrically contacts the electrodes of adjacent piezoelectric elements.

4 Claims, 11 Drawing Sheets

SLOTTED CYLINDER ACOUSTIC TRANSDUCER

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention generally relates to acoustic transducers and more particularly, to slotted cylinder acoustic transducers.

(2) Description of the Prior Art

An acoustic transducer possesses the capability to transfer mechanical energy to electrical energy and vice versa. Typically, the acoustic transducer utilizes piezoelectric materials that react to pressure differentials by emitting an electrical charge. Therefore, any pressure wave impinging on an underwater transducer will generate an electrical charge proportional to the magnitude of the pressure. As a result, one can monitor underwater pressure differentials by monitoring the output charge from the piezoelectric material and associated transducer—in an operation very similar to the use of an underwater microphone.

Alternately, by controlling the input voltage magnitude and signal characteristics, one can generate equivalent pressure waves underwater with a result very similar to an underwater speaker. Examples of such tasks for underwater acoustic transducers include scanning for shipwrecks or other underwater objects; probing the ocean floor for oil reserves; and monitoring temperature fluctuations in the ocean.

Slotted cylindrical acoustic transducers, also known as Slotted Cylinder Projectors ("SCPs"), are known in the art. Many prior art slotted cylindrical acoustic transducers use piezoelectric material (i.e. lead zirconate titanate, or PZT) as an active material. In a typical slotted cylindrical acoustic transducer, piezoelectric plates are adhesively bonded to the inner wall of a slotted cylindrical shell. The slots runs along the length of the cylinder. A cylinder can have either a constant-wall thickness or a tapered-wall thickness.

Slotted cylinder acoustic transducers are described in U.S. Pat. Nos. 6,002,649, 6,678,213 and 7,719,926. U.S. Pat. No. 6,002,649, entitled "Tapered Cylinder Electro-Acoustic Transducer with Reversed Tapered Driver" describes an electro-acoustic transducer that uses a cylinder having a tapered thickness. A piezoelectric driver element is located in the interior cavity of a cylindrical shell. The shell is fabricated from a metal or a laminated composite material. The driver element is mechanically-connected to the cylindrical shell by an epoxy bond between the outer surface of the driver element and the inner surface of the cylindrical shall. The driver element comprises a plurality of piezoelectric ceramic elements circumferentially arranged in a stack.

U.S. Pat. No. 6,678,213, entitled "Slotted Cylinder Transducer with Trapezoidal Cross-Sectional Electrodes" describes a slotted cylinder transducer that uses a cylinder that has a uniform thickness. A plurality of ceramic elements and electrodes are alternately disposed circumferentially on the inner surface of the cylinder.

U.S. Pat. No. 7,719,926, entitled "Slotted Cylinder Acoustic Transducer", describes a slotted cylinder acoustic transducer that has a slotted cylindrical shell and a stack of piezoelectric ceramic elements that are bonded to the inner wall of the cylindrical shell. Electrodes are interposed in the stack of piezoelectric ceramic elements, wherein one electrode is positioned between a pair of adjacent piezoelectric ceramic elements. The slotted cylindrical shell has a tapered thickness.

Other acoustic transducer devices that use conventional piezoelectric material are described in U.S. Pat. Nos. 2,812,452, 3,773,898, 4,220,887, 4,257,482, 4,651,044, 5,229,978, 6,069,845, 6,285,631 and 6,781,288. Ferroelectric crystals are described in U.S. Pat. No. 3,773,898, entitled "Compound Ferroelectric-Ferroelastic Crystal", and in U.S. Pat. No. 5,998,910, entitled "Relaxor Ferroelectric Single Crystals For Ultrasound Transducers".

What is therefore needed is an improved slotted cylinder acoustic transducer that is relatively smaller in size and lighter in weight than the aforesaid prior art slotted cylinder acoustic transducers but yet is capable of providing the same acoustic power output as prior art slotted cylinder acoustic transducers.

SUMMARY OF THE INVENTION

Accordingly, it is a primary object and general purpose of the present invention to provide an improved slotted cylinder acoustic transducer that is relatively smaller in size and lighter in weight than prior art slotted cylinder acoustic transducers.

A further object of the present invention is to provide a slotted cylinder acoustic transducer that has a significantly higher bandwidth than prior art slotted cylinder acoustic transducers.

A still further object of the present invention is to provide a slotted cylinder acoustic transducer that has significantly lower acoustic impedance than prior art slotted cylinder acoustic transducers.

Accordingly, the present invention is directed to a low-frequency, slotted cylinder, acoustic transducer that projects low frequency (<500 Hz) pressure waves with large magnitudes. The slotted cylinder acoustic transducer of the present invention has a relatively smaller size and lighter weight than prior art slotted cylinder acoustic transducers; thereby, reducing required manpower and logistical resources when deploying the acoustic transducer.

Accordingly, in one aspect, the present invention is directed to a slotted cylinder acoustic transducer, comprising a cylindrical housing shell having an inner surface, an outer surface, a central major axis of curvature, a length and a thickness between the inner surface and the outer surface. The thickness is in a direction perpendicular to the central major axis of curvature. The cylindrical housing shell has a slot therethrough that extends in a direction parallel to the central major axis of curvature. The slot forms a gap in the cylindrical housing shell.

The slotted cylinder acoustic transducer further comprises an electromechanical driver disposed within the interior of the cylindrical housing shell. The electromechanical driver includes a plurality of single crystal piezoelectric elements joined to the inner surface of the cylindrical housing shell and arranged to form an electromechanical stack assembly. Each single crystal piezoelectric element has a pair of sidewalls wherein each sidewall comprises an electrode having a predetermined polarity.

The slotted cylinder acoustic transducer further comprises a plurality of electrically conductive members. Each electrically conductive member is positioned between each pair of adjacent single crystal piezoelectric elements and electrically contacts the electrodes of the adjacent single crystal piezoelectric elements.

In a related aspect, the present invention is directed to an electromechanical stack for use in a slotted cylinder acoustic transducer. The electromechanical stack comprises a plurality of single crystal piezoelectric elements arranged circumferentially. Each single crystal piezoelectric element has a pair of sidewalls and a tapered width between the sidewalls. Each sidewall comprises an electrode having a predetermined polarity. The electromechanical stack further comprises a plurality of electrically conductive members. Each electrically conductive member is disposed between each pair of adjacent single crystal piezoelectric elements and electrically contacts the electrodes of adjacent single crystal piezoelectric elements.

BRIEF DESCRIPTION OF THE DRAWINGS

A more complete understanding of the invention and many of the attendant advantages thereto will be appreciated as the same becomes better understood by reference to the following detailed description when considered in conjunction with the accompanying drawings wherein corresponding reference characters indicate corresponding parts throughout the several views of the drawings and wherein.

DETAILED DESCRIPTION OF THE INVENTION

Figure 1:
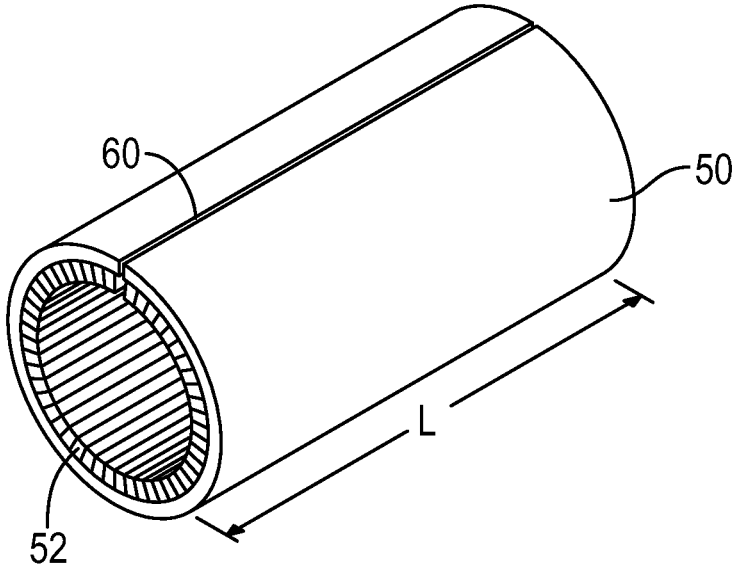
FIG. 1 is a perspective view of a cylindrical housing shell and electromechanical driver used in a slotted cylinder acoustic transducer in accordance with one embodiment of the present invention.
Figure 2:
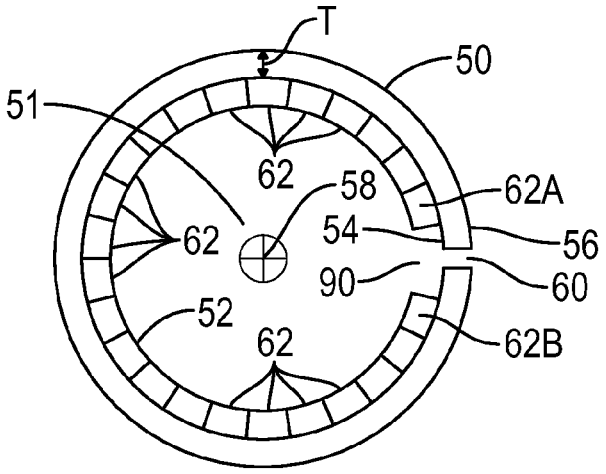
FIG. 2 is an end view of the cylindrical housing shell and electromechanical driver depicted in FIG. 1.
Figure 3:
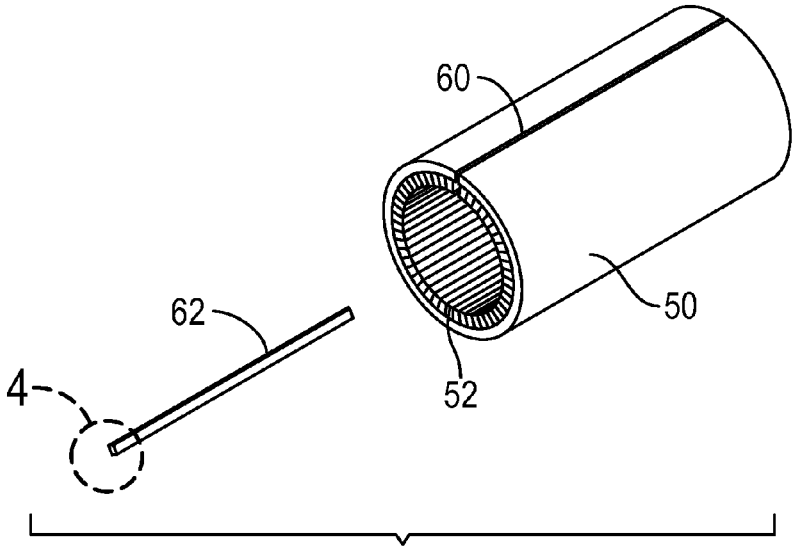
FIG. 3 is an exploded view depicting the cylindrical housing shell and electromechanical driver of FIG. 1 and one of a plurality of single crystal piezoelectric elements used to form the electromechanical driver.
Figure 4:
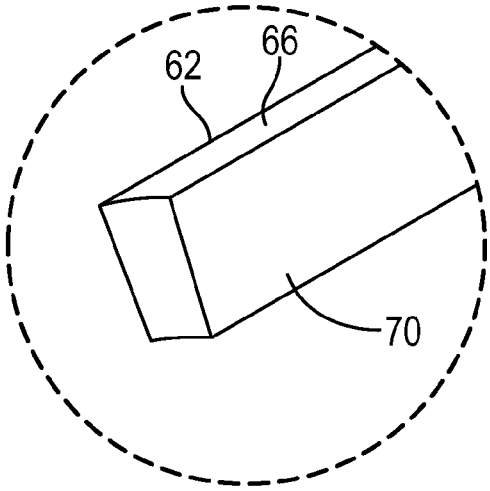
FIG. 4 is an enlarged view of a portion of the view depicted in FIG. 3, the view showing a portion of the single crystal piezoelectric element.
Figure 5:
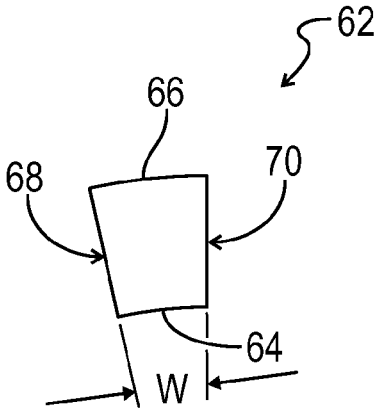
FIG. 5 is an end view of the single crystal piezoelectric element depicted in FIG. 3 and FIG. 4.

Referring now to the drawings, and more particularly to FIG. 1 and FIG. 2, there is shown slotted cylindrical housing shell 50 that is used in the slotted cylinder acoustic transducer of the present invention. An electromechanical driver 52 is disposed within an interior 51 of the shell 50.

The shell 50 has an inner surface 54, an outer surface 56, a central major axis of curvature 58, a thickness "T" between the inner surface 54 and the outer surface 56, and a length "L". The thickness is in a direction perpendicular to the central major axis of the curvature 58. The shell 50 has a slot 60 therethrough that extends in a direction parallel to the central major axis of curvature 58.

The slot 60 forms a gap in the shell 50. In this particular embodiment of the invention, the thickness T of the shell 50 is uniform throughout the circumference of the shell. The shell 50 is fabricated from a material that provides the slotted cylinder acoustic transducer with the desired center operating frequency, such fabrication is known in the art. In one embodiment, the shell 50 is fabricated from a graphite-epoxy material. However, in other embodiments, the shell 50 is fabricated from aluminum, an aluminum alloy, steel or an iron alloy.

Referring to FIGS. 1-5, the electromechanical driver 52 comprises a plurality of single crystal piezoelectric elements 62 joined to the inner surface 54 and arranged to form an electromechanical stack assembly. Each single crystal piezoelectric element 62 has a surface 64, an opposite surface 66, and a pair of sidewalls that comprise electrodes 68 and 70. The electrodes 68 and 70 are discussed in greater detail in the ensuing description. The surface 66 of each single crystal piezoelectric element 62 is adhesively bonded to the inner surface 54. In one embodiment, a two-component epoxy structural adhesive is used to bond the single crystal piezoelectric elements 62 to the inner surface 54.

Each single crystal piezoelectric element 62 has a width "W" between sidewalls. The width W tapers from the surface 66 to the surface 64. Each single crystal piezoelectric element 62 is formed from single crystal piezoelectric material known as PMN-PT or PZN-PT. The electrodes 68 and 70 are formed from a sputtering process in which a thin layer of metal is deposited on the sidewalls of the single crystal piezoelectric substrate. In one embodiment, the aforesaid metal is Gold. However, other suitable metals may be used (e.g. Silver, Nickel, Copper, Aluminum and/or alloys thereof). The sputtering process is well known in the art and therefore is not described herein.

In one embodiment, the electrode 68 is the positive polarity electrode and the electrode 70 is the negative polarity electrode. In an alternate embodiment, the single crystal piezoelectric element 62 is configured so that the electrode 68 is the negative polarity electrode and the electrode 70 is the positive polarity electrode.

Figure 6:
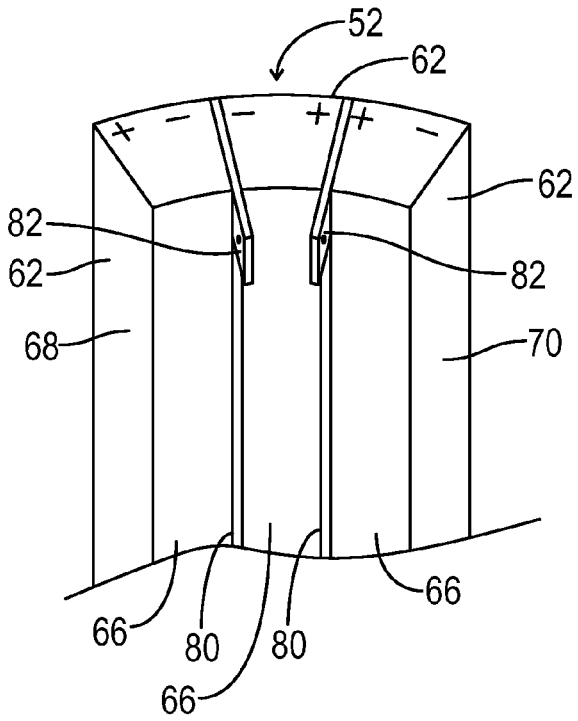
FIG. 6 is a partial view, in perspective, of several single crystal piezoelectric elements that are depicted in FIGS. 1-3, the view depicting electrical conductive members between each pair of adjacent single crystal piezoelectric elements.
Figure 7:
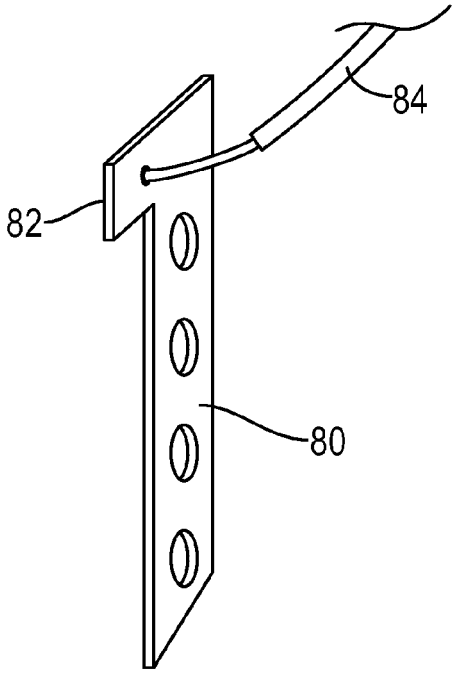
FIG. 7 is a perspective view of the electrically conductive member shown in FIG. 6.

Referring to FIG. 6 and FIG. 7, an electrically conductive member 80 is disposed between each pair of adjacent single crystal piezoelectric elements 62 and electrically contacts the electrodes of the adjacent single crystal piezoelectric elements. For example, the electrically conductive member 80 electrically contacts the electrode 68 of one of the single crystal piezoelectric elements 62 and the electrode 70 of the adjacent single crystal piezoelectric element 62.

Figure 8:
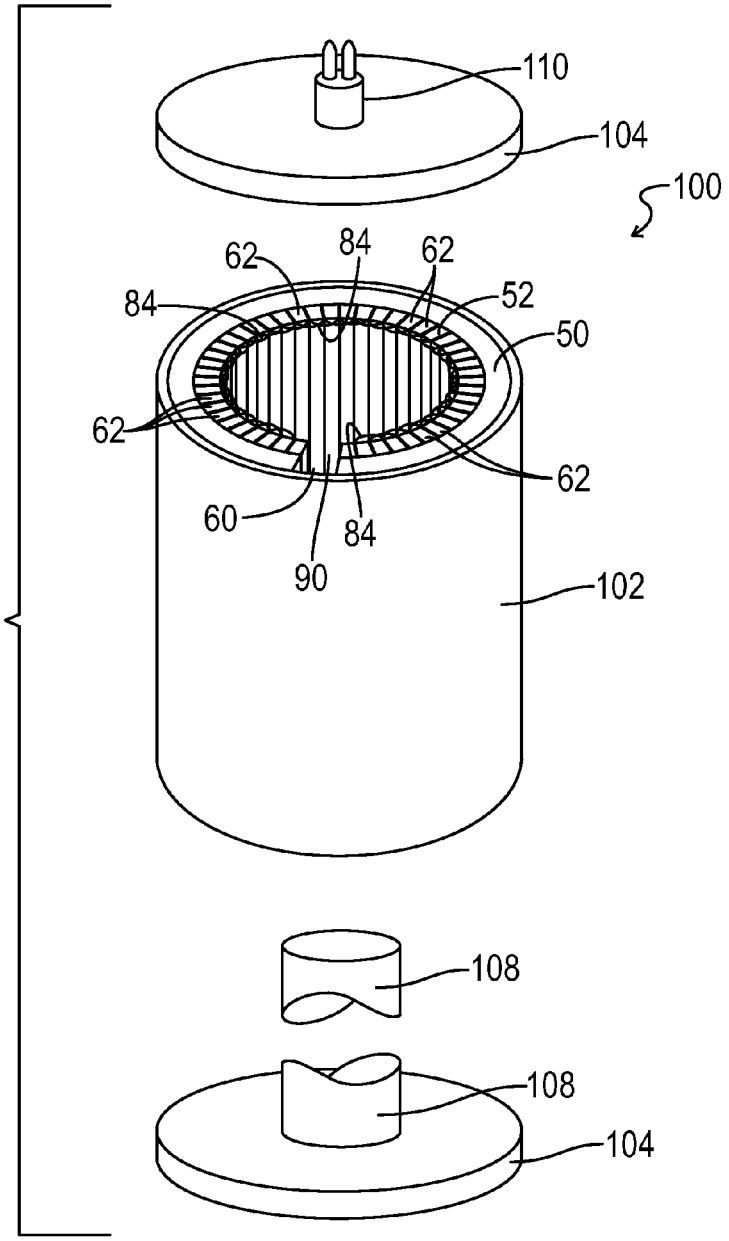
FIG. 8 is an exploded view of a slotted cylinder acoustic transducer in accordance with one embodiment of the present invention.

In a preferred embodiment, each electrically conductive member 80 comprises metal foil. Each electrically conductive member 80 comprises a tab portion 82. As shown in FIG. 6, each tab portion 82 extends from the electromechanical driver 52. Referring to FIG. 7 and FIG. 8, electrical conductors 84 are connected to the tab portions 82 such that all single crystal piezoelectric elements 62 are electrically connected together in a parallel circuit. In a preferred embodiment, the electrical conductors 84 are wires.

Referring to FIG. 2, the electromechanical driver 52 is configured to have a predetermined quantity of the single crystal piezoelectric elements 62 so as to yield a gap or slot 90 which is in proximity to the slot 60. In such a configuration, the single crystal piezoelectric elements 62 that are positioned on either side of the slot 90, indicated by reference numbers 62A and 62B, are in electrical contact only with one other single crystal piezoelectric element 62.

Referring to FIG. 8, there is shown an exploded view of a slotted cylinder acoustic transducer 100 in accordance with one embodiment of the present invention. The slotted cylinder acoustic transducer 100 comprises the cylindrical housing shell 50 and the electromechanical driver 52. In order to isolate the electromechanical driver 52 and the interior 51 from the surrounding medium (e.g., water), the cylinder housing shell 50 is encased in an elastomer material, or a rubber boot 102. Covers 104 are provided to seal the open ends of cylinder housing shell 50. Post 108 is attached to one of the covers 104 and extends through the interior 51 and is attached to the other cover by any suitable means (such as screw threads, or the like).

When the transducer 100 is assembled, the post 108 serves to maintain a slight separation between the covers 104 and the shell 50 so that the covers do not constrain the radial displacement of the shell. When the transducer 100 is assembled, the boot 102 extends over and is sealed to the covers 104 so that the interior of the cylinder housing shell 50 and electromechanical driver 52 are not exposed to the medium (e.g. water). An underwater cable connector 110 penetrates one of the covers 104 and is electrically connected to the electrical conductors 84. Thus, the electromechanical driver 52 is electrically-connected to the underwater cable connector 110. Electrical power is applied to the underwater cable connector 110 and thus, to the electromechanical driver 52.

In operation, when the transducer 100 is excited with an alternating, electrical signal, the electromechanical driver 52 expands and contracts in response to the signal. The expansion and contraction of the electromechanical driver 52 results in radial displacement of the housing shell 50 in the vicinity of the slot 60. This displacement, or flexural vibration corresponding to the expansion and contraction of the electromechanical driver 52, generates the acoustic signal.

Figure 9:
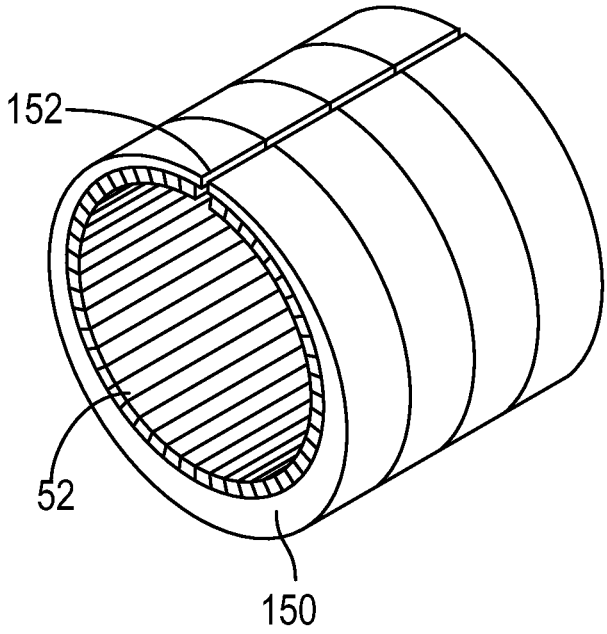
FIG. 9 is a perspective view of a cylindrical housing shell and electromechanical driver in accordance with another embodiment of the present invention.

Referring to FIG. 9, there is shown a slotted cylindrical housing shell 150 in accordance with another embodiment of the invention. In this embodiment, the thickness of slotted cylindrical housing shell 150 is tapered, wherein the thickness of cylindrical housing shell is greatest at a position opposite slot 152 and smallest at positions proximate to a slot 152.

The single crystal piezoelectric elements 62 of the electromechanical driver 52 are bonded to the inner surface of the cylindrical housing shell 150 in the same manner as the single crystal piezoelectric elements 62 are bonded to the inner surface 54 of the cylindrical housing shell 50. The transducer 100, shown in FIG. 8, may be modified to replace the cylindrical housing shell 50 with the tapered cylindrical housing shell 150. The tapered cylindrical housing shell 150 has a relatively higher bandwidth than the cylindrical housing shell 50.

The single crystal piezoelectric elements 62 exhibit five times the strain energy density of conventional piezoceramics. Thus, unlike piezoceramic actuators that employ strain magnification schemes, single crystal piezoelectric actuators can deliver higher strain levels without sacrificing generative force. The high electromechanical coupling of these single crystal piezoelectric elements increases transducer bandwidth, resulting in greater sensitivity and acoustic power. In addition, low strain hysteresis results in improved high power efficiency, and lower acoustic impedance than piezoceramics. The relatively lower acoustic impedance allows for easier matching to air or water.

Figure 10:
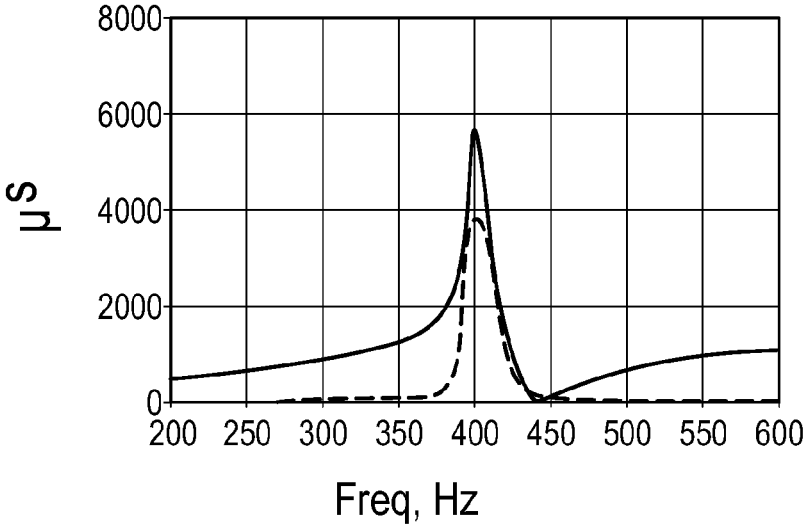
FIG. 10 is a graph that shows the admittance responses for the slotted cylinder acoustic transducer of FIG. 8.
Figure 11:
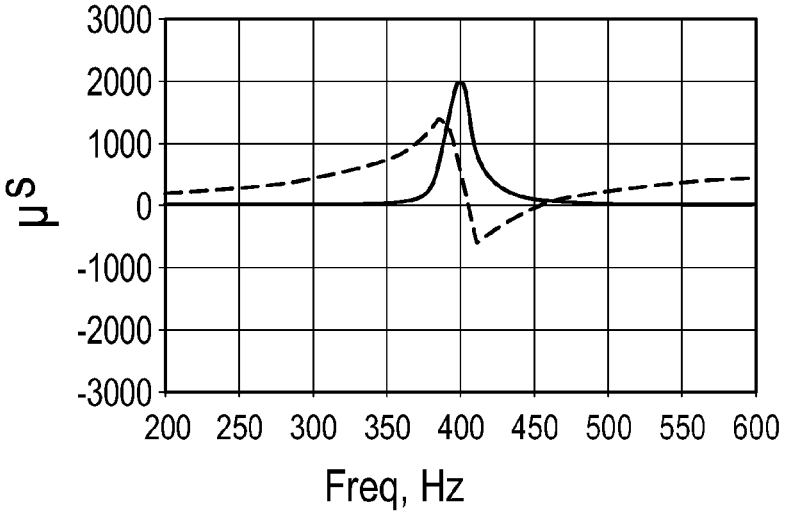
FIG. 11 is a graph that shows the admittance responses for a slotted cylinder acoustic transducer that uses the cylindrical housing shell and electromechanical driver of FIG. 9.

FIG. 10 shows the admittance response for a slotted cylinder acoustic transducer using the cylindrical housing shell 50. FIG. 11 shows the admittance response for a slotted cylinder acoustic transducer using the cylindrical housing shell 150. The resonant frequency is defined at the frequency where both curves peak, and where both curves swap from concave up to concave down. The resonant frequency is 400 HZ for the slotted cylinder acoustic transducer using cylindrical housing shell 50. The resonant frequency is also 400 HZ for the slotted cylinder acoustic transducer using the cylindrical housing shell 150. An equivalent prior art slotted cylinder acoustic transducer using conventional piezoelectric ceramics would have a resonant frequency of 750 HZ, almost double the resonant frequency of the slotted cylinder acoustic transducer of the present invention.

A transducer comprising the cylindrical housing shell 50 and the electromechanical driver 52 was constructed with a 0.072 meter diameter and a 0.13 meter length. A slotted cylinder acoustic transducer comprising the cylindrical housing 150 and the electromechanical driver 52 was constructed with a 0.12 meter in diameter, and 0.013 meter in length. The dimensions of both of these transducers were relatively small relative to the acoustic wavelength of the frequency at which each transducer is resonant, 3.75 meters; thereby, providing both transducers with the ability to radiate pressure waves with equivalent magnitudes in all directions. Such a characteristic is desirable for low frequency sound sources used for wide area surveillance.

Single crystal piezoelectric elements exhibit five times the strain energy density of conventional piezoceramics. Thus, unlike piezoceramic actuators that employ strain magnification schemes, single crystal piezoelectric actuators can deliver higher strain levels without sacrificing generative force. The high electromechanical coupling of these single crystal piezoelectric elements increases transducer bandwidth, resulting in greater sensitivity and acoustic power.

In addition, low strain hysteresis results in improved high power efficiency, and lower acoustic impedance than piezoceramics. The relatively lower acoustic impedance allows for easier matching to air or water. The slotted cylinder acoustic transducer of the present invention can be made smaller than the prior art slotted cylinder acoustic transducers but yet with the capability to provide the same acoustic power capabilities.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An acoustic transducer assembly, comprising:

a cylindrical housing shell having an interior with open ends, an inner surface, an outer surface, a central axis of curvature and a length, said cylindrical housing shell having a slot therethrough that extends in a direction parallel to the axis of curvature and which forms a gap in said cylindrical housing shell;

a electromechanical driver disposed within said housing shell, said electromechanical driver comprising a plurality of single crystal piezoelectric elements adhesively bonded to the inner surface of said housing shell and arranged to form an electromechanical stack assembly, each said single crystal piezoelectric element having a pair of sidewalls with a tapering width between said sidewalls, wherein each sidewall comprises an electrode having a predetermined polarity with each of said electrodes having opposite polarities wherein one electrode has a positive polarity and the other electrode has a negative polarity;

a plurality of electrically conductive members, each said conductive member positioned between a pair of adjacent single crystal piezoelectric elements such that said electrically conductive member electrically contacts electrodes of said adjacent single crystal piezoelectric elements with each said conductive member including a tab portion that extends from said electromechanical stack assembly;

electrical conductors to electrically connect together said tab portions such that said crystal piezoelectric elements are electrically connected in parallel;

a pair of covers, each cover corresponding to one of the open ends of said housing shell wherein one of said covers includes an underwater cable connector;

a post that extends through the interior of said cylindrical housing shell with each end of said post attached to said covers wherein said post serves to maintain a slight separation between said covers and said housing shell;

an elastomeric material covering said housing shell and said covers; and an underwater cable connector which penetrates one of said covers and is electrically connected to said electrical conductors and said electromechanical driver.

2. The acoustic transducer of claim 1 wherein said cylindrical housing shell has a thickness between the inner surface and the outer surface, the thickness being in a direction perpendicular to the central axis of curvature.

3. The slotted cylinder acoustic transducer of claim 2 wherein the thickness of said cylindrical housing shell is uniform throughout the circumference of said cylindrical housing shell.

4. The acoustic transducer of claim 2 wherein the thickness of said cylindrical housing shell tapers such that the thickness is greatest at a position opposite the slot and smallest at a position proximate to the slot.

* * * * *